US005475987A

United States Patent [19]

McGovern

[11] Patent Number: 5,475,987

[45] Date of Patent: Dec. 19, 1995

[54] REFRIGERATED DISPLAY CASE APPARATUS WITH ENHANCED AIRFLOW AND IMPROVED INSULATION CONSTRUCTION

[75] Inventor: Christopher McGovern, Allentown, N.J.

[73] Assignee: Delaware Medical Formation, Inc., Wilmington, Del.

[21] Appl. No.: 340,929

[22] Filed: Nov. 17, 1994

[51] Int. Cl.[6] ..... A47F 3/04

[52] U.S. Cl. ..... 62/256

[58] Field of Search ..... 62/255, 256

[56] References Cited

U.S. PATENT DOCUMENTS

| | | |
|---|---|---|
| Re. 31,909 | 6/1985 | Ibrahim . |
| D. 307,080 | 4/1990 | Cocagne . |
| D. 323,258 | 1/1992 | Miyabayashi . |
| 2,241,854 | 5/1941 | Hall et al. . |
| 2,495,554 | 1/1950 | Spangler . |
| 2,936,596 | 5/1960 | Rainwater . |
| 2,960,844 | 11/1960 | Quick . |
| 3,063,254 | 11/1962 | Dickson et al. . |
| 3,082,612 | 3/1963 | Beckwith . |
| 3,094,851 | 6/1963 | Beckwith . |
| 3,122,892 | 3/1964 | Beckwith . |
| 3,583,118 | 6/1971 | Lowery . |
| 3,648,482 | 3/1972 | Beckwith et al. . |
| 3,729,889 | 5/1973 | Baruzzini . |
| 3,751,653 | 8/1973 | Henry . |
| 3,805,545 | 4/1974 | Buchser et al. . |
| 4,026,121 | 5/1977 | Aokage et al. . |
| 4,117,698 | 10/1978 | Vogel . |
| 4,135,369 | 1/1979 | Allgeyer et al. . |
| 4,242,882 | 1/1981 | Abraham . |
| 4,299,092 | 11/1981 | Ibrahim . |
| 4,319,463 | 3/1982 | Ljung . |
| 4,361,012 | 11/1982 | Ibrahim . |
| 4,367,632 | 1/1983 | Ibrahim et al. . |
| 4,369,632 | 1/1983 | Abraham . |
| 4,370,866 | 2/1983 | Abraham . |
| 4,408,465 | 10/1983 | Ibrahim . |
| 4,514,988 | 5/1985 | Ibrahim . |
| 4,744,611 | 5/1988 | Tamura et al. . |
| 4,753,043 | 6/1988 | Bockwinkel . |
| 4,840,040 | 6/1989 | Fung . |
| 4,852,303 | 8/1989 | Rolek . |
| 4,876,860 | 10/1989 | Negishi . |
| 4,964,281 | 10/1990 | Tanaka . |
| 5,199,273 | 4/1993 | Silva et al. . |

FOREIGN PATENT DOCUMENTS

| | | |
|---|---|---|
| 952329 | 2/1965 | Canada . |
| 2016669 | 9/1978 | United Kingdom . |

*Primary Examiner*—William E. Tapolcai
*Attorney, Agent, or Firm*—Sperry, Zoda & Kane

[57] ABSTRACT

An improved design for a refrigerated display case which significantly enhances airflow characteristics by including a gradual radius within the transition sections in areas where the refrigerated airflow path must change directions to greatly facilitate smooth flow of refrigerated air therethrough. Also disclosed is an improved construction for providing insulation for a refrigerated display case including an inner and outer panel spaced apart to define an insulation holding chamber therebetween and including thermal breakers at the ends thereof for maintaining the panels in spaced relation to each other and for closing off the end section thereof to retain insulation therein. The inner insulation panel defines the outer boundary of the airflow path. Also an improved design for a shelf support standard is positioned within the insulated housing to provide structural strength to the display case apparatus and to support shelving thereon and also to include a case liner secured thereto for defining the inner boundary of the improved airflow path. Thermally non-conductive bolt assemblies are included to attach the insulated foam assemblies to shelf support standards. The design further includes a novel castor configuration to facilitate relocation of the refrigerated display case.

21 Claims, 6 Drawing Sheets

REFRIGERATED DISPLAY CASE APPARATUS WITH ENHANCED AIRFLOW AND IMPROVED INSULATION CONSTRUCTION

BACKGROUND OF THE INVENTION

1. Field Of The Invention

The present invention deals with the field of devices for displaying products to be purchased by a consumer. The designs of the present invention are particularly usable for such display cases which are refrigerated to retain therein displayed items which must be maintained in refrigeration in order to increase shelf life. Such designs commonly include an open front area with an air curtain passing thereover to minimize the loss of refrigeration from within the display area of the display case while at the same time facilitating access of a shopper to the items displayed therein.

2. Description Of The Prior Art

Many prior art devices have been disclosed which provide constructions for improving the design of refrigerated display cases which include open fronts with refrigerated air curtains passing thereover. Examples of such are shown in U.S. Pat. No. 952,329; and U.S. Pat. No. 2,241,854 issued May 13, 1941 to K. W. Hall et al and assigned to Telco. Inc. on an "Air Conditioned Display Compartment"; and U.S. Pat. No. 2,495,554 issued Jan. 24, 1950 to G. Spangler and assigned to Ed. Friedrich, Inc. on an "Open-Top Refrigerated Display Case"; and U.S. Pat. No. 2,936,596 issued May 17, 1960 to J. Rainwater and assigned to The Warren Company, Inc. on a "Frozen Food Display Case"; and U.S. Pat. No. 2,960,844 issued Nov. 22, 1960 to L. Quick on "Refrigerated Showcases"; and U.S. Pat. No. 3,063,254 issued Nov. 13, 1962 to E. Dickson et al and assigned to Hussmann Refrigerator Co. on a "Food Merchandiser"; and U.S. Pat. No. 3,082,612 issued Mar. 26, 1963 to S. Beckwith and assigned to Dual Jet Refrigeration Company on a "Refrigerated Cabinet And Defrosting Means"; and U.S. Pat. No. 3,094,851 issued Jun. 25, 1963 to S. Beckwith and assigned to Dual Jet Refrigeration Company on a "Refrigeration Cabinet And Defrost"; and U.S. Pat. No. 3,122,892 issued Mar. 3, 1964 to S. Beckwith and assigned to dual Jet Refrigeration Company on a "Refrigerated Display Cabinet And Method of Operation"; and U.S. Pat. No. 3,583,118 issued Jun. 8, 1971 to W. Lowery and assigned to Control Building Systems, Inc. on "Insulated Panel Structures And Connections"; and U.S. Pat. No. 3,648,482 issued Mar. 14, 1972 to S. Beckwith et al and assigned to Kysor Industrial Corporation on a "Method And Apparatus For Producing Refrigerating Constructions"; and U.S. Pat. No. 3,729,889 issued May 1, 1973 to G. Baruzzini and assigned to Pet Incorporated on a "Modular Insulated Panel System"; and U.S. Pat. No. 3,751,653 issued Aug. 7, 1973 to J. Henry and assigned to Emhart Corporation on a "Refrigerated Display Case"; and U.S. Pat. No. 3,805,545 issued Apr. 23, 1974 to W. Buchset et al and assigned to Whirlpool Corporation on a "Separator Wall Structure"; and U.S. Pat. No. 4,026,121 issued May 31, 1977 to Y. Aokage et al and assigned to Fuji Denki Seizo Kabushiki Kaisha on a "Defrosting In Open Show Case Of Cold-Air-Circulation Type"; and U.S. Pat. No. 4,117,698 issued Oct. 3, 1978 to R. Vogel and assigned to Kysor Industrial Corporation on a "Refrigerated Display"; and U.S. Pat. No. 4,135,369 issued Jan. 23, 1979 to D. Allgeyer et al and assigned to UMC Industries, Inc. on a "Dual Temperature Merchandiser"; and U.S. Pat. No. 4,242,882 issued Jan. 6, 1981 to F. Abraham and assigned to Tyler Refrigeration Corporation on a "Glass Door Merchandiser"; and U.S. Pat. No. 4,299,092 issued Nov. 10, 1981 to F. Ibrahim and assigned to Tyler Refrigeration Corporation on an "Energy Conserving Refrigerated Merchandiser Display Case"; and U.S. Pat. No. 4,319,463 issued Mar. 16, 1982 to H. Ljung and assigned to Aktiebolaget Electronlux on a "Refrigerated Display Chest"; and U.S. Pat. No. 4,361,012 issued Nov. 30, 1982 to F. Ibrahim and assigned to Tyler Refrigeration Corporation on an "Energy Efficient Refrigerated Merchandiser Display Case"; and U.S. Pat. No. 4,367,632 issued Jan. 11, 1983 to F. Ibrahim et al and assigned to Tyler Refrigeration Corporation on a "Flexible Door Operating Mechanism For Refrigerated Merchandizer Display Cabinet"; and U.S. Pat. No. 4,369,632 issued Jan. 25, 1983 to F. Abraham and assigned to Tyler Refrigeration Corporation on a "Refrigerated Merchandiser Display Case"; and U.S. Pat. No. 4,370,866 issued Feb. 1, 1983 to F. Abraham and assigned to Tyler Refrigeration Corporation on a "Removable Duct Panel For Multiband Refrigerated Display Cases"; and U.S. Pat. No. 4,408,465 issued Oct. 11, 1983 to F. Ibrahim and assigned to Tyler Refrigeration Corporation on a "Multiband Refrigerated Display Case Having A Top Access Opening"; and U.S. Pat. No. 4,514,988 issued May 7, 1985 to F. Ibrahim and assigned to Tyler Refrigeration Corporation on a "Refrigerated Display Case Having Ambient Air Defrost"; and U.S. Pat. No. Re.31,909 issued Jun. 11, 1985 to F. Ibrahim and assigned to Tyler Refrigeration Corporation on a "Refrigerated Display Case Having Ambient Air Defrost"; and U.S. Pat. No. 4,744,611 issued May 17, 1988 to F. Tamura et al and assigned to Sanden Corporation on a "Display Cabinet"; and U.S. Pat. No. 4,753,043 issued Jun. 28, 1988 to G. Bockwinkel and assigned to Ardco Inc. on a "Pivotally Mounted Insulated Glass Door Assembly With Self-Contained Structural Support Frame"; and U.S. Pat. No. 4,840,040 issued Jun. 20, 1989 to K. Fung and assigned to American Standard Inc. on an "Island Type Refrigeration Display Cabinet"; and U.S. Pat. No. 4,852,303 issued Aug. 1, 1989 to M. Rolek and assigned to Ardco, Inc. on a "Refrigerator Door Frame With Insulated Mullion"; and U.S. Pat. No. 4,876,860 issued Oct. 31, 1989 to K. Negishi and assigned to Sanden Corporation on a "Refrigerator With Variable Volume Independently Cooled Storage Chambers"; and U.S. Pat. No. 4,964,281 issued Oct. 23, 1990 to T. Tanaka and assigned to Sanyo Electric Co., Ltd. on a "Low-Temperature Showcase"; and U.S. Pat. No. Des.307,080 issued Apr. 10, 1990 to P. Cocagne and assigned to Bonnet Refrigeration on a "Refrigerated Display Case"; and U.S. Pat. No. Des.323,258 issued Jan. 21, 1992 to H. Miyabayashi and assigned to Sanyo Electric Co., Ltd. on a "Freezer Showcase"; and U.S. Pat. No. 5,199,273 issued Apr. 6, 1993 to R. Silva et al and assigned to The Manitowoc Company, Inc. on a "Reach-In Cooler With interchangeable Refrigerator And Freezer Systems"; and British Patent 2 016 669 A issued to H. French on "Refrigerated Display Cabinets".

SUMMARY OF THE INVENTION

The present invention provides an improved refrigerated display case construction which has enhanced radial airflow characteristics and an improved design for insulation thereof. The insulated housing preferably includes an outer housing panel having a lower outer section extending generally horizontally and including a lower outer section front end in the front area thereof and a lower outer section rear end in the rear portion thereof. A front outer section will preferably extend vertically upwardly from the lower outer section front end and a rear outer section will preferably extend generally vertically upwardly from adjacent the lower outer section rear end in a position disposed spaced rearwardly from the front outer section. Also preferably an upper outer section will extend forwardly from the rear outer section at a location above the lower outer section.

In a similar manner the insulated housing will also include an inner housing panel mounted with respect to the outer housing panel at a position spatially disposed therefrom in order to define a chamber therebetween for holding the insulation. This insulation chamber will provide a means for insulation of the entire refrigerated display case. Furthermore the inner panel housing will define a refrigerated airflow path thereadjacent oppositely positioned from the insulation chamber.

The construction of the inner housing panel will include a lower inner section extending generally horizontally above the lower outer section and including a lower inner section front end and a lower inner section rear end. A front inner section extends generally vertically upward from the lower inner section front end. A rear inner section will extend generally vertically upward from adjacent the lower inner section rear end spatially disposed rearwardly from the front inner section.

Furthermore an upper inner section will extend forwardly from the rear inner section at a location above the lower inner section. A first inner transition section will extend between the lower inner section and the front inner section and will be arcuate with a radius of curvature of approximately six inches at all points therealong to facilitate the flow of refrigerated air thereagainst. In a similar manner a second inner transition section will extend between the lower inner section and the rear inner section and will be arcuate with a radius of curvature of approximately six inches at all points therealong to facilitate the flow of refrigerated air thereagainst. Further additionally, a third inner transition section will extend between the rear inner section and the upper inner section and be arcuate with a radius of curvature of approximately six inches at all points therealong to facilitate the flow of refrigerated air thereagainst.

In the preferred configuration all of the sections of the inner housing panel will be straight except for the three transition sections each of which pass through an angle of approximately 90 degrees and each of which includes no arcuate sections thereon having a radius of curvature of less than approximately six inches. In this manner the air will more easily flow through those sections of the airflow path which require the air to change direction of flow. By using a relatively large (6 or 8 inch) radius of curvature in the panels that define the air flow path the refrigerated air can achieve a more fully laminar flow character which greatly increases total air flow volume. Smoothness of air flow is further enhanced by the even spacing of the surfaces which define the air flow path at a generally uniform spacing distance from one another of approximately two inches. The assemblies of the present invention are designed to minimize the use of any type of separate fastener devices.

The present invention further contemplates the inclusion of a thermal breaker means attached to the outer housing panel and the inner housing panel at a position therebetween. The thermal breaker means will maintain the outer housing panel and the inner housing panel spatially disposed from one another along the entire length and width thereof in order to uniformly define the thermal insulation chamber therebetween. The thermal breaker will preferably include a first lower thermal breaker having a general U-shape which is adhered to the outer housing panel along the lower outer section thereof and adhered to the inner housing panel along the lower inner section thereof. Also the thermal breaker will include a second lower thermal breaker which is also U-shaped and is attached to the outer housing panel along the lower outer section and the inner housing panel along the lower inner section spatially disposed from the first lower thermal breaker to facilitate defining therebetween the thermal insulation chamber.

A first upper thermal breaker will also be included which is generally L-shaped and will be attached to the outer housing panel along the upper outer section and attached to the inner housing panel along the upper inner section. A similarly configured second upper thermal breaker which is L-shaped will be attached to the outer housing panel along the upper outer section and attached to the inner housing panel along the upper inner section spatially disposed from the first upper thermal breaker in order to facilitate defining therebetween the insulation retaining chamber in the upper portion of the insulated housing.

A thermal insulation means will be positioned within this insulation chamber between the outer housing panel and the inner housing panel and between the first lower thermal breaker and the second lower thermal breaker to facilitate insulation of the refrigerated display case and the refrigerated airflow path defined therein.

A shelf support standard which can be C-shaped may be secured to the insulation housing along the inner housing panel. This shelf support standard preferably will extend vertically and will provide main structural strength throughout the display case design. The shelf support standard will also define a plurality of mounting positions thereon for receiving and retaining a shelving attached thereto. The shelf support standard preferably will include two or more vertically extending shelf support standards made of square tubular steel which can provide a plurality of openings therein to facilitate mounting of shelving at appropriate locations as required. These openings preferably will provide a plurality of possible vertical positions for the shelving at spaced increments of approximately one inch. The use of two inch square tubular steel as the material of the shelf standard is useful to provide the main structural strength member of the display case of the present invention.

In the basic design of a case, one C-shaped shelf support standard will be positioned at each opposite end thereof. This overall embodiment will provide significant structural strength. In some case designs where additional structural strength is possibly needed, additional support standards can be utilized. These additional standards can be positioned at any intermediate location between the C-shaped shelf standards at the ends of the case. These intermediate shelf standards also need not include the complete C-shaped construction, but could be of a more abbreviated shape such as partial C-shaped or L-shaped as found to be necessary. Use of such additional structural support standards has been shown to provide significant additional strength as well as excellent resistance to flexing or deflection of the case configuration responsive to load or other forces.

A case liner means may be included with the present invention attached to the first shelf support standard and the second support standard such as to extend therebetween in spaced relation from the inner housing panel of the insulated housing to thereby define the refrigerated airflow path therebetween. Positioning of the case liner is assured mainly by the structural strength of the shelf support standard.

A general frame structure may also be fixedly secured to the insulated housing for mounting thereon to facilitate movement thereof and for strengthening. A castor means may be detachably securable with respect to the frame to facilitate movement or relocation of the refrigerated display case as required. The castors preferably are detachably securable with respect to the frame to allow them to be removed once the frame is in a final location and allow them to be re-attached if movement of the case is desired. For this purpose a castor securement construction is included including a plate fixedly secured to the castor such that the castor wheel itself can rotate with respect to the plate. A mounting bracket is fixedly secured to the frame and defines a mounting pocket therein adapted to receive a plate detachably secured therein. The mounting bracket may include a shoulder member extending outwardly from the mounting bracket adjacent the mounting pocket defined therein to receive the mounting plate extending thereover to facilitate detachable securement with respect to the mounting pocket. Also a locking pin such as a cotter pin can be included to extend within a mounting aperture defined within the mounting bracket and extending therethrough at a position spatially disposed from the shoulder member. This mounting aperture preferably is adapted to receive the locking pin in such a manner as to extend below the plate for detachable securement of the castor with respect to the frame.

To facilitate securement of the inner and outer insulation panel a plurality of securement bolt assemblies can be included extending through the insulation housing for securement therebetween. Each of these securement bolt assemblies preferably includes a thermally insulated bolt member which can be formed of a fiber material to prevent loss of heat therethrough and to increase the efficiency of the insulation housing of the refrigerated display case of the present invention.

Also with the present design a thermal end breaker of high density structural foam can be used to form a lower end cap which may extend between the front outer section and the front inner section to define the insulation chamber means therein and to retain thermal insulation therein. Similar material can be used to form an upper cap may extending between the upper outer section and the upper inner section to define the insulation chamber therein and to retain the thermal insulation therein.

To enhance the universal modularity of usage of the apparatus of the present invention the thermal breaker configuration can include an intermediate rear thermal member positioned between the lower thermal breaker and the upper thermal breaker. This intermediate rear thermal member can be available in different modular lengths in order to allow use of the standard parts of the refrigerated display case of the present invention to construct cases having different total vertical heights as required in specific applications. Also the configuration of the thermal breakers can include an upper extension thermal breaker member securable to the upper thermal breaker and extending horizontally outwardly therefrom toward the top front of the case. These upper extension thermal breaker members can be made available in different sizes to allow use of the same modular parts of a refrigerated display case to form different cases having different horizontal dimensions and configurations in the canopy areas thereof.

It is an object of the present invention to provide an improved refrigerated display case apparatus with enhanced radial airflow characteristics and improved insulation means wherein the refrigerated flow path does not include any sharp bends or turns therein and does include only gradually curved sections with a radius of curvature always greater than approximately six inches to facilitate laminar air flow therethrough.

It is an object of the present invention to provide an improved refrigerated display case apparatus with enhanced airflow characteristics and improved insulation means wherein a sturdy tubular frame standard is included for suspending shelving therefrom.

It is an object of the present invention to provide an improved refrigerated display case apparatus with enhanced airflow characteristics and improved insulation means wherein a two inch square steel tubular frame is included to transfer all loads, to act as a consistent two inch spacer for the air flue, to provide interior panel support, to provide multiple shelf mounting locations and to be used as the frame to secure case sections with respect to adjacently positioned case sections.

It is an object of the present invention to provide an improved refrigerated display case apparatus with enhanced airflow characteristics and improved insulation means wherein an insulated housing extends around the entire case including an inner and outer skin mounted in spaced relation with respect to one another with thermal insulation positioned therebetween.

It is an object of the present invention to provide an improved refrigerated display case apparatus with enhanced airflow characteristics and improved insulation means wherein mounting bolt assemblies are utilized which are non-thermally conductive and can include bolts of fiber material.

It is an object of the present invention to provide an improved refrigerated display case apparatus with enhanced airflow characteristics and improved insulation means wherein energy efficiency is maximized.

It is an object of the present invention to provide an improved refrigerated display case apparatus with enhanced airflow characteristics and improved insulation means wherein costs of operation are minimized.

It is an object of the present invention to provide an improved refrigerated display case apparatus with enhanced airflow characteristics and improved insulation means wherein a positive refrigeration airflow is achievable.

It is an object of the present invention to provide an improved refrigerated display case apparatus with enhanced airflow characteristics and improved insulation means wherein there is no requirement for use of wood at any location.

It is an object of the present invention to provide an improved refrigerated display case apparatus with enhanced airflow characteristics and improved insulation means wherein thermal breakers of hard foam form lateral barriers to the insulated chambers.

It is an object of the present invention to provide an improved refrigerated display case apparatus with enhanced airflow characteristics and improved insulation means wherein refrigerated air flow is achieved with less static pressure.

It is an object of the present invention to provide an improved refrigerated display case apparatus with enhanced airflow characteristics and improved insulation means wherein remarkable temperatures are achievable with only moderate energy consumption.

It is an object of the present invention to provide an improved refrigerated display case apparatus with enhanced airflow characteristics and improved insulation means wherein castors can be factory mounted to a sturdy base frame.

It is an object of the present invention to provide an improved refrigerated display case apparatus with enhanced airflow characteristics and improved insulation means wherein castors allow cases to be rolled off of a truck to the line-up position and the castors can thereby be easily removed once the refrigerated display case is in the proper location.

It is an object of the present invention to provide an improved refrigerated display case apparatus with enhanced airflow characteristics and improved insulation means wherein additional costs of construction are minimized.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
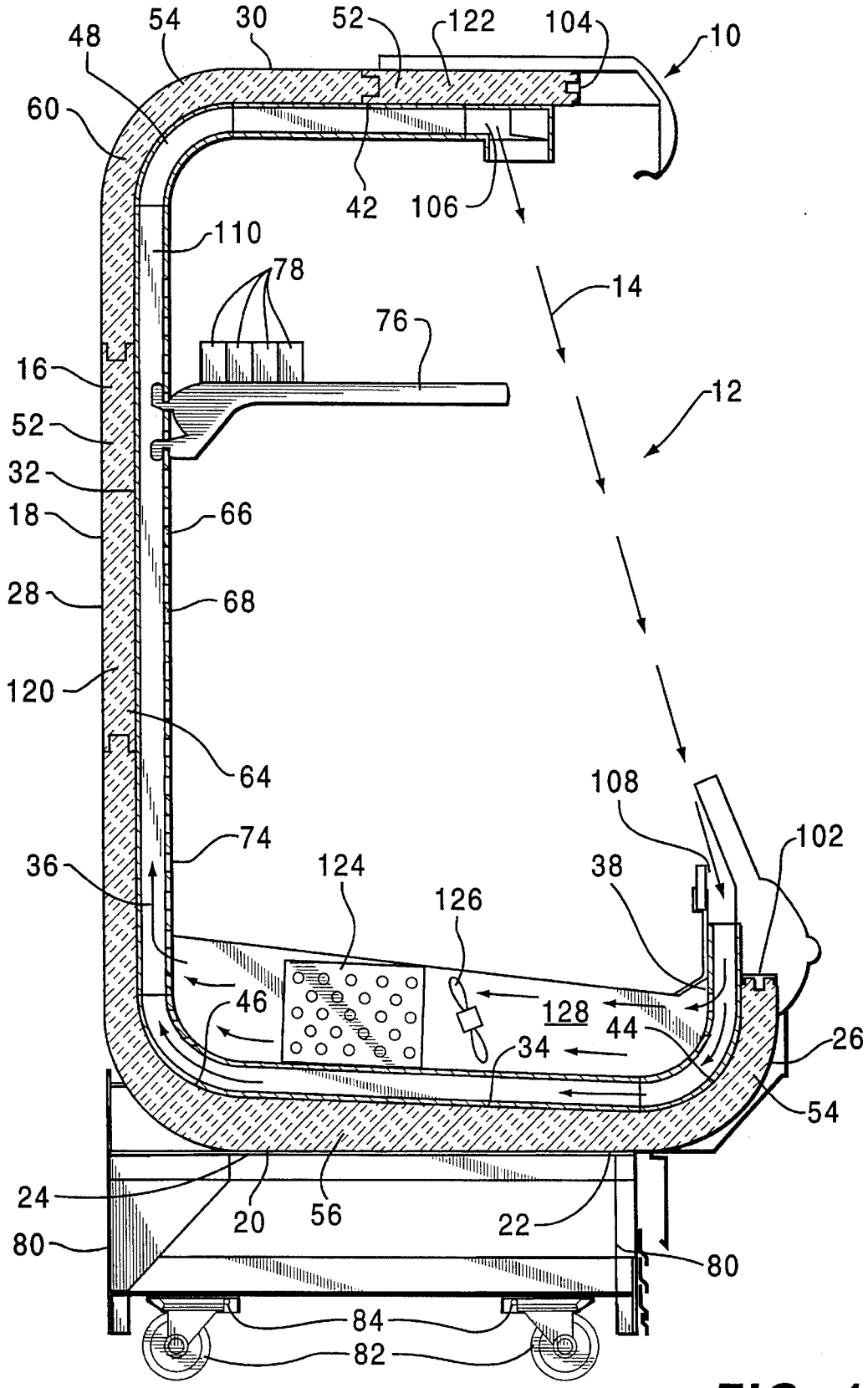
FIG. 1 is a left side plan view of an embodiment of the improved refrigerated display case apparatus of the present invention.

The present invention provides an improved design for a refrigerated display case 10 which normally is configured with an open front 12 with an air curtain 14 passing downwardly thereacross to retain the refrigerated air within the case 10, The design of the present invention includes an insulated housing 16 which comprises an outer housing panel 18 and an inner housing panel 32, Panels 18 and 32 are maintained apart from one another by a thermal breakers 54 which are approximately two inches thick, The space between the outer housing panel 18 and the inner housing panel 32 defines a thermal insulation chamber 52 which is adapted to receive a thermal insulation material 64 therein, such as polyurethane foam, for insulating of the refrigerated display case 10, The configuration of the outer housing panel 18 preferably includes a lower outer section 20 extending generally parallel and attachable with respect to a frame 80 therebelow, The lower outer section 20 will include a lower outer section front end 22 and a lower outer section rear end 24 defined thereon. The lower outer section front end 22 is preferably closer to the front of the case or to the right as seen in FIG. 1 and the lower outer section rear end 24 is the end of the lower outer section 20 closer to the rear portion of the case or to the left as shown in FIG. 1.

A front outer section 26 will preferably extend upwardly from the lower outer section 20 to form a vertically extending panel immediately below the open front 12. As such, the front outer section 26 will preferably be secured to the lower outer section 20 at the lower outer section front end 22 thereof.

In a similar manner a rear outer section 28 will extend upwardly from the lower outer rear end 24 to define the rear wall of the display case 10. This housing will extend upwardly to the upper outer section 30 which extends generally horizontally inwardly therefrom to a location immediately adjacent to the upper end of the open front 12.

The inner housing panel 32 which is spaced inwardly from the outer housing panel 18 will include a lower inner section 34 extending generally horizontally above the lower outer section 20 and generally parallel thereto. A front inner section 38 will extend upwardly from the front end of the lower inner section 34 and be spaced from and extend generally parallel with respect to the front outer section 26. In a similar manner a rear inner section 40 will extend vertically from the rear portion of the lower inner section 34 and be generally parallel to the rear outer section 28 to define therebetween the insulation retaining chamber 52. The rear inner section 40 will extend generally vertically. An upper inner section 42 will extend generally horizontally from the upper end of the rear inner section 40 toward the front of the case at the upper portion thereof and will extend to an area adjacent to the upper portion of the open front 12.

The inner housing panel 32 will define the outer boundary of the refrigerated airflow path 36 to facilitate the movement of air through this path and to create a positive airflow path with minimal fluid flow resistance therein. The airflow path should be defined with very gradual arcuate surfaces. The air flow path will be located between the outer housing panel 18 and the inner housing panel 32 throughout the refrigerated display case 10 except in the lower area thereof. In the lower or tank area the air flow path will extend through the plenum area 128 in order to be refrigerated while passing through the refrigeration coil 124 as directed by the fan means 126.

Since the inner housing panel 32 defines the outer boundary of the airflow path, it is important that the curved surfaces in this path have a large radius to prevent restrictions to the normal laminar fluid flow characteristics of air as a fluid.

It is a specific object of the present invention to provide an airflow path with minimal resistance extending from the refrigerated air curtain lower inlet 108 to the refrigerated air curtain upper outlet 106. A blower or fan means 126 will be included to push the air upwardly from the inlet 108 to the outlet 106 and the air will also pass through a refrigeration coil means 124 within the plenum area 128 for cooling thereof. Normally there is a severe restriction in the airflow path immediately after the air travels through the inlet 108 since the air must change its inertia from extending vertically downwardly to extending horizontally rearwardly. To ease in the transition from movement vertically along the front inner section 38 to horizontally rearwardly along the lower inner section 34 a first inner transition section 44 will be included defined by the inner housing panel 32 therebetween. This first inner transition section 44 will have a radius of curvature approximately six inches to allow for refrigerated airflow therethrough with minimal resistance.

In a similar manner it is necessary that the refrigerated air path traveling to the left as shown in FIG. 1 toward the rear portion of the case have the inertia thereof oriented to extend vertically upward as it passes on to the rear inner section 40 of the inner housing 32. This gradual change in the vector of the inertia is achieved by a second inner transition section 46 which interconnects the rear portion of the lower inner section 34 with the rear inner section 40.

As the refrigerated air flows upwardly along the refrigerated airflow path 36 to the upper portion of the display case, it is then necessary that the air be directed to flow to the right as shown in FIG. 1. This change in momentum of the air will be achieved by the intersection between the rear inner section 40 and the upper inner section 42. To facilitate this transition a third inner transition section 48 will extend therebetween with a radius of curvature of approximately six inches such as to allow movement of the air upwardly and to the right as shown in FIG. 1 toward the refrigerated air curtain upper outlet 106 with a minimum of resistance to flow thereof. The radius of curvature of approximately six inches is shown as reference numeral 50 and this is the minimum radius of curvature at all locations for the first, second and third inner transition sections 44, 46 and 48, respectively.

Figure 2:
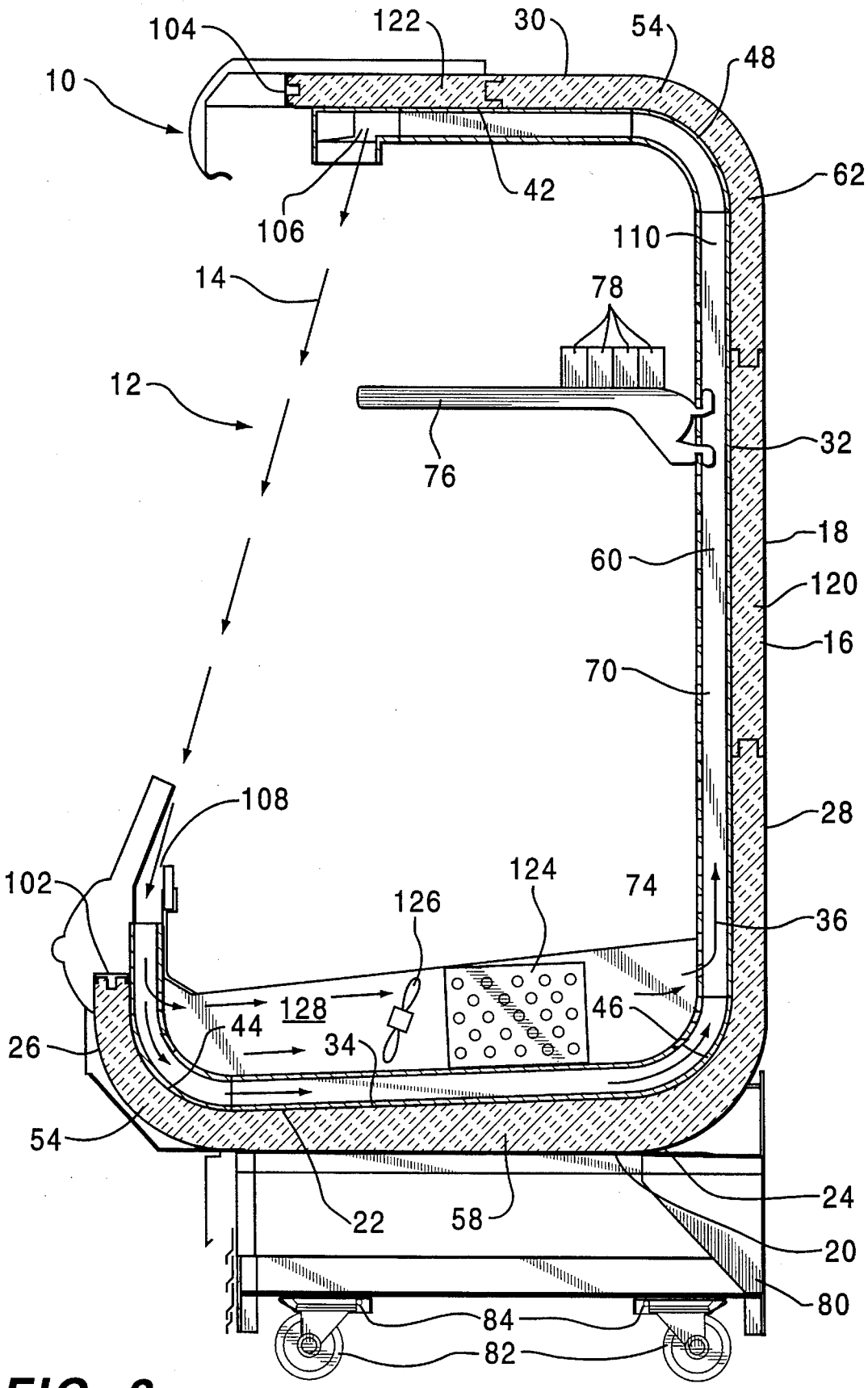
FIG. 2 is a right side plan view of the embodiment shown in FIG. 1.

The structure of the insulated housing 16 includes the thermal breaker means preferably comprising four separate thermal breaker numbers. On one side of the housing a first lower thermal breaker 56 will be positioned between lower inner section 34 and the lower outer section 20 for maintaining the outer housing 18 separated from the inner housing 32 along the lower portion thereof. A second lower thermal breaker 58 will be positioned similar to the first lower thermal breaker 56 but at the opposite end of the case as shown in FIG. 2.

In a similar manner a first upper thermal breaker 60 will be positioned between the upper inner section 42 and the upper outer section 30 for holding the outer housing 18 at a distance from the inner housing 32 to allow the definition of the thermal insulation chamber 52 therebetween and the positioning of thermal insulation material 64 therein. In a similar manner a second upper thermal breaker 62 may be positioned on the opposite end of the case from the first upper thermal breaker as shown in FIG. 2.

Structurally the present invention will further include a shelf support standard 66 which can include a first shelf support standard 68 as well as a second shelf support standard 70 each being located adjacent to opposite ends of the case. The primary purpose of the shelf support standards 68 and 70 is to provide structural strength to the overall configuration of the refrigerated display case 10 of the present invention. Also, these shelf support standards preferably define a plurality of slots therein which comprise shelf mounting locations 72 for the positioning of the shelf means 76 thereon. These shelves are adapted to receive displayed product 78 positioned thereon to facilitate access thereto by a user by reaching through the open front 12 of the case 10.

Figure 4:
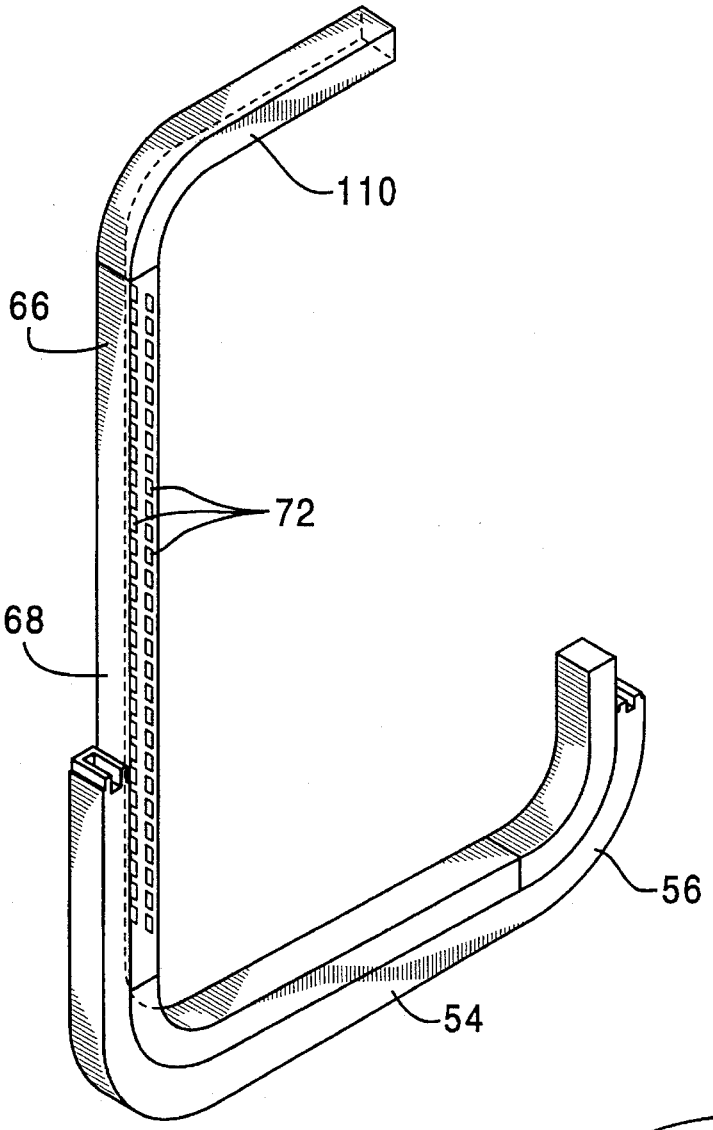
FIG. 4 is a side perspective illustration of an embodiment of the thermal breaker of the present invention shown secured with respect to an embodiment of the shelf support standard of the present invention.
Figure 5:
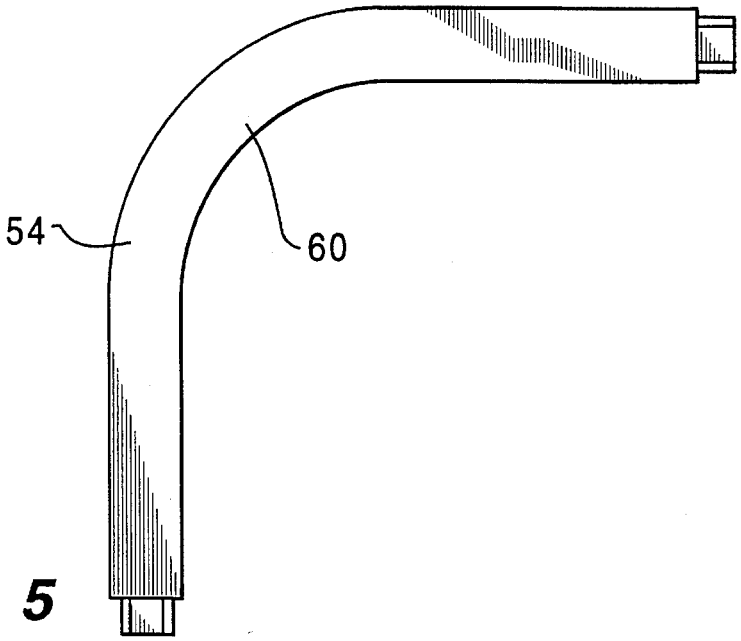
FIG. 5 is a side plan view of an embodiment of the upper thermal breaker of the present invention.
Figure 6:
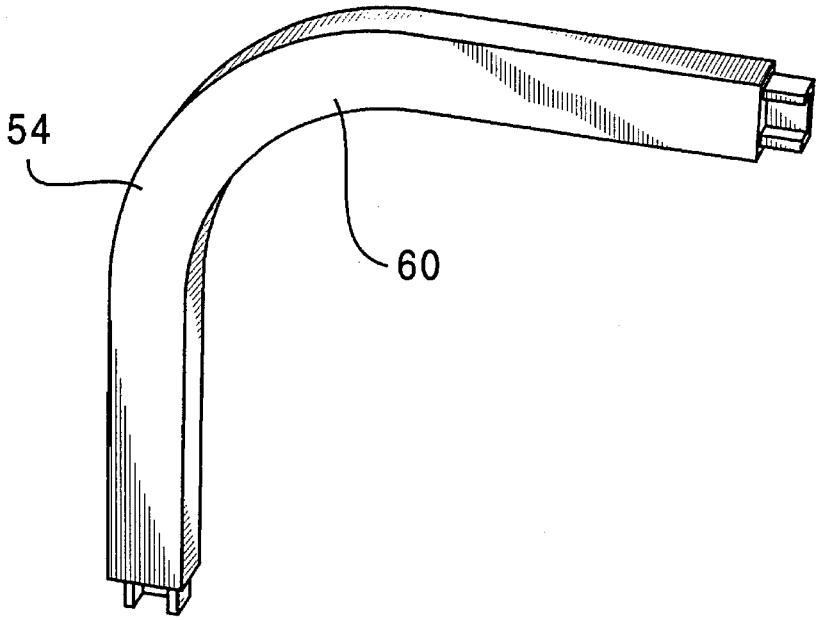
FIG. 6 is a perspective illustration of the embodiment shown in FIG. 5.
Figure 7:
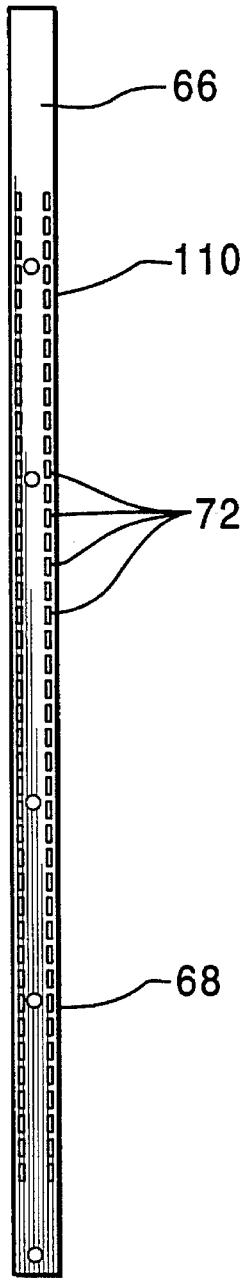
FIG. 7 is a front plan view of an embodiment of the shelf support standard of the present invention.
Figure 8:
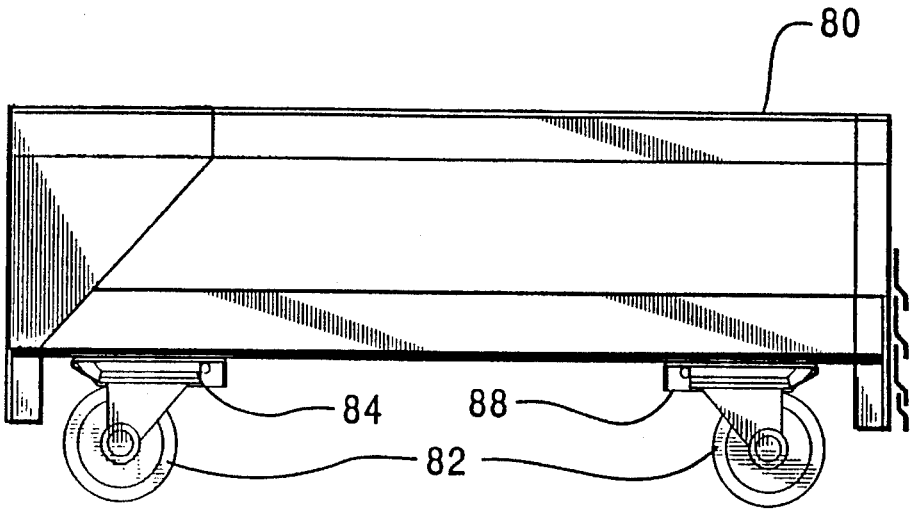
FIG. 8 is a side plan view of an embodiment of the frame of the present invention showing the castors locked in position.
Figure 9:
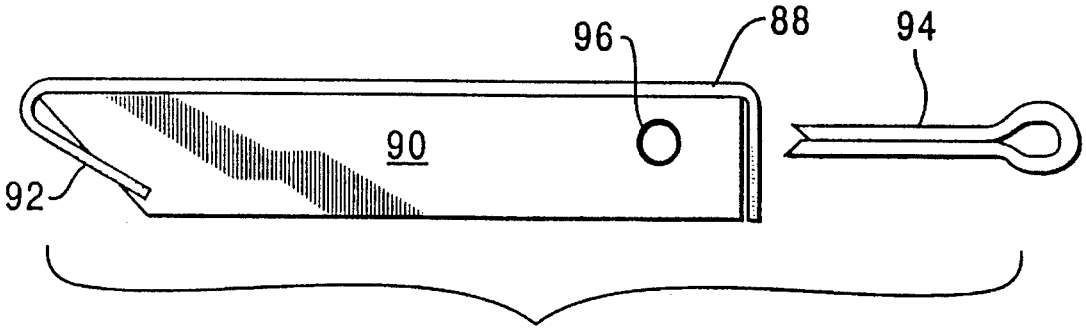
FIG. 9 is a side plan view of an embodiment of the castor securement means of the present invention; an FIG. 10 is a side plan view of the castor of the present invention shown secured with respect to the mounting bracket of the castor securement means.
Figure 10:
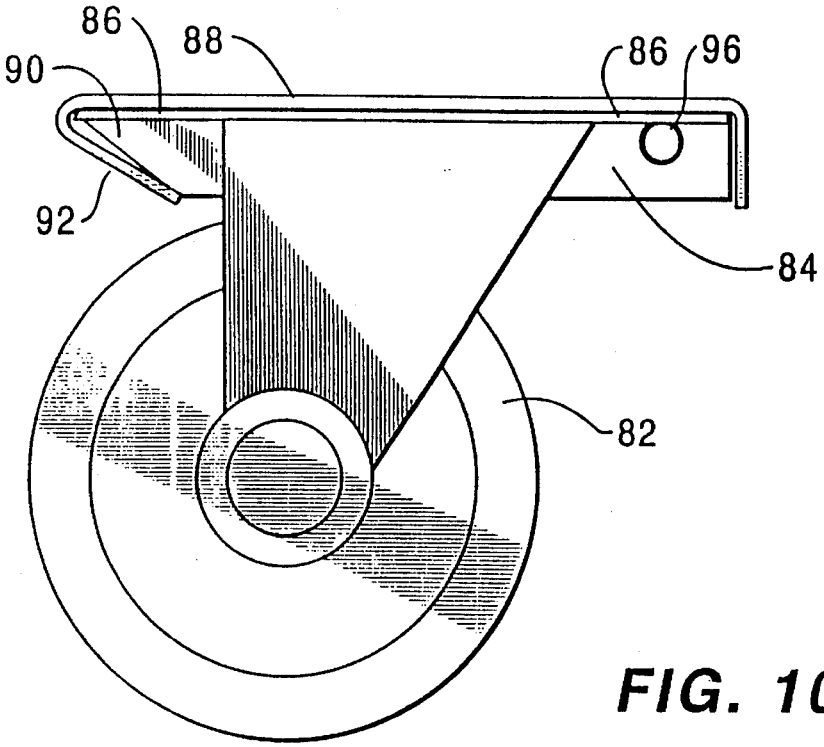

A case liner means 74 is preferably secured with respect to the shelf support standard 66 in such a manner as to extend over the rear portion of the case and define the inner boundary of the refrigerated airflow path 36. Usually the case liner 74 will be formed of a relatively flexible material but when secured to the shelf standard formed usually of tubular steel, the case liner will provide a fixedly positioned surface. Case liner 74 will preferably extend between the two C-shaped shelf support standards 68, 70 in such a manner as to extend generally parallel to the inner housing panel means 32 completely thereover and thereby define the refrigerated airflow path 36 therebetween. To facilitate mounting of the case liner 74 with respect to the shelf support standard 66 it is preferable that the standard 66 be formed of an extremely strong construction and with extremely close tolerances and great precision due to the structural requirements thereof. This strong construction is made possible by the use of two inch square tubular steel as the material for construction thereof. This configuration utilizing two inch square tubular steel is shown best in FIGS. 4 and 7.

To seal the front edge of the thermal insulation chamber 52 a lower end cap means 102 can extend between the frontmost edge of the outer housing panel 18 and the inner housing panel 32 at a position immediately below the open front area 12. This lower end cap 102 will thereby seal the thermal insulation chamber to facilitate placement of insulation thereof.

In a similar manner an upper end cap means 104 can be positioned extending between the outer housing panel 18 and the inner housing panel 32 at a position along the uppermost edge thereof adjacent the upper end of the open front 12 to further facilitate retaining of thermal insulation therein.

Thermal insulation of refrigerated display cases has often been compromised by the assembly hardware utilized to attach various components. The present invention, however, overcomes this prior difficulty by the use of thermally insulated securement bolt assemblies 98. These assemblies 98 preferably use thermally insulated fiber bolts 100 which can extend through the outer housing panel 18 and the inner housing panel 32 but will not compromise the insulating characteristics thereof since the bolts and hardware are formed of a fiber material which itself is thermally non-conductive. The use of such bolt assemblies is shown best in FIG. 3.

A refrigerated display case made in accordance with currently available design parameters tends to be a rather heavy item and is difficult to move by installation personnel. As such, the present invention provides a novel means for detachably securing of castors with respect to the frame 80 to allow significantly more rapid movement of a display case 10 to a desired location and the easy removal of the castors therefrom.

This configuration includes the castor means 82 each of which includes a plate 86 secured thereto. The castor wheel of course is free to rotate with respect to the plate and the plate itself is detachably secured with respect to the frame 80 of the case 10 by a castor securement device 84. The castor securement device 84 comprises a mounting bracket 88 fixedly secured to the frame 80 and defining a mounting pocket 90 therein. This mounting pocket 90 is adapted to receive a castor plate 86 detachably therein. The mounting bracket will also define a mounting aperture 96 therein adapted to receive a locking pin 94 such as a cotter pin or the like therein.

Also the mounting bracket 88 defines a shoulder member 92 immediately adjacent the mounting pocket to further facilitate retaining of the plate 86 with respect to the frame 80.

Installation of the castor 82 is achieved by placement of the castor plate 86 thereof into the mounting pocket 90 of the mounting bracket 88 at a position with one end thereof above the shoulder member 92. The other end is then moved vertically upwardly above the mounting aperture 96 and the locking pin or cotter pin 94 is placed therein to thereby secure the plate 86 as well as the castor 82 with respect to the frame 80. Relocation of the display case 10 is then possible. Once the case is in the desired location the case can be elevated slightly on one end with the locking pin 94 being removed and the mounting plate being withdrawn from the mounting pocket 90 thereby releasing the castor 82 from the frame 80. The castor can then be again used with respect to another case which requires relocation.

Figure 3:
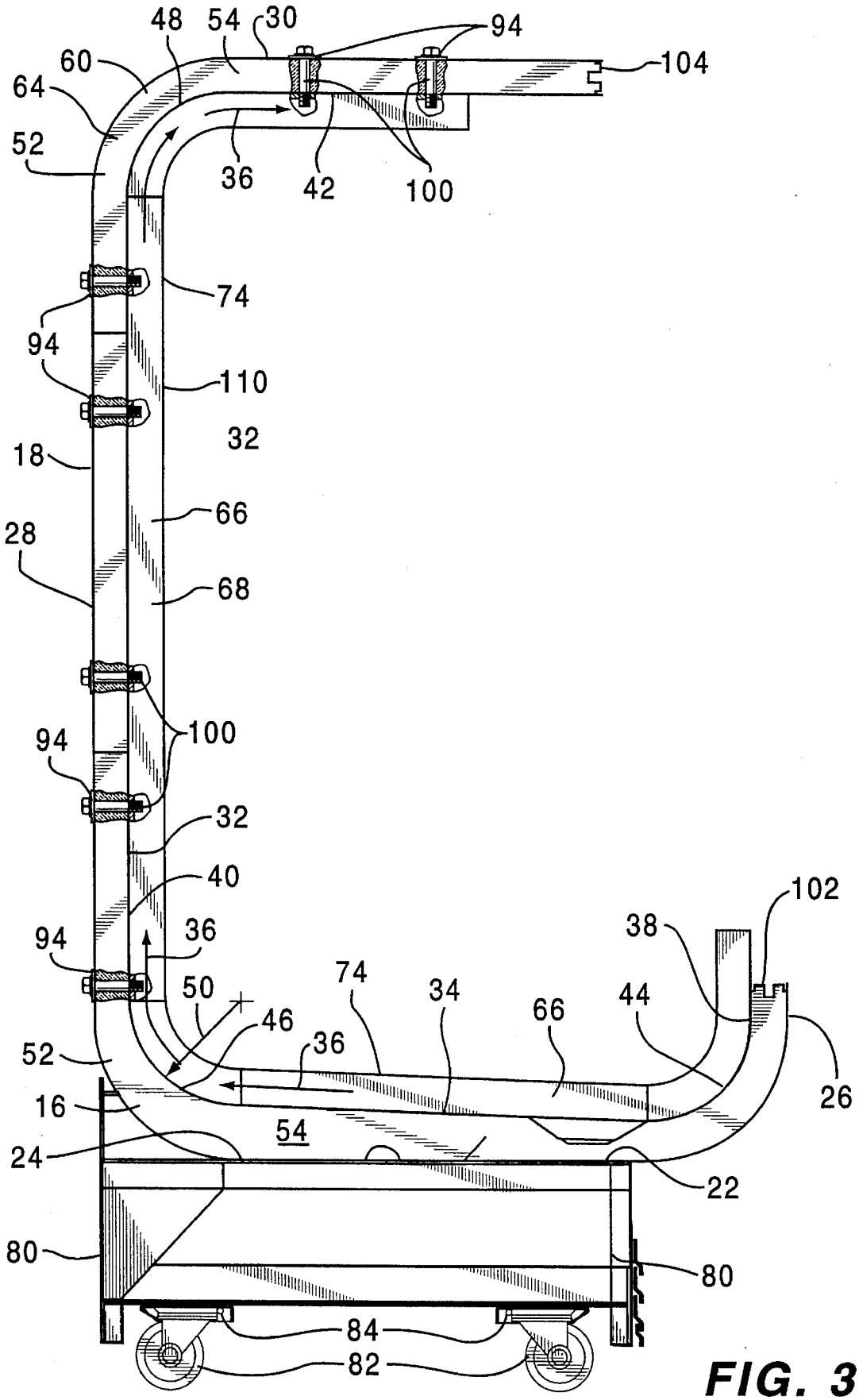
FIG. 3 is a side cross sectional view of the embodiment shown in FIG. 1.

In the construction of the present invention it is preferable that the lower portion of the insulated housing 16 include additional insulation. As such, the first lower thermal breaker 56 and the second lower thermal breaker 58 are preferably configured somewhat wider in the lower portions to increase the spacing between the outer housing panel 18 and the inner housing panel 32 as shown best from the side view as seen in FIGS. 1–3. This additional spacing allows additional insulation to be placed therein since cold air tends to move downwardly and therefore the temperature differential across the insulated housing is greater in the lower portions of the case than in the upper portions. The chosen profile for the first lower thermal breaker 56 and the second lower thermal breaker 58 does not effect the airflow characteristics since the refrigerated airflow path 36 located thereadjacent is positioned inwardly from the inner housing panel 32. Thus, the outer housing panel 18 can be spaced at a greater distance from the inner housing panel 32 in the area adjacent the lower portion of the case where heat loss is more of a problem. Also preferably the lower interior case surfaces are angled slightly toward the front of the case to facilitate liquid spillage drain off and to urge movement of waste materials toward the waste outlets defined in the front lower tank area. The slight angle may be approximately two degrees angled forwardly.

To further add to the universal modularity of usage of the apparatus of the present invention the configuration of the thermal breakers 54 can include an intermediate rear thermal members 120 positioned between the lower thermal breakers 56 and 58 and the upper thermal breakers 60 and 62. These intermediate rear thermal member 120 can be available in different modular lengths in order to allow use of the standard parts of the refrigerated display case 10 of the present invention to construct cases having different total vertical heights as required in different store applications. Also the configuration of the thermal breakers 54 can include an upper extension thermal breaker members 122 securable to the upper thermal breakers 60 and 62 and extending horizontally outwardly therefrom toward the top front of the case 10 as shown in FIGS. 1 and 2. These upper extension thermal breaker members 122 can be made available in different sizes to allow use of the same modular parts of a refrigerated display case 10 to form case configurations having different horizontal dimensions and configurations in the canopy or upper areas thereof.

In the basic design of a case 10, one C-shaped shelf support standard 66 will be positioned at each opposite end thereof. This overall design will provide significant structural strength. In some case constructions will be required where additional structural strength is possibly needed, and additional support standards 66 can be utilized. These additional standards can be positioned at any intermediate location between the C-shaped shelf standards 56 at the ends of the case. These intermediate shelf standards also need not include the complete C-shaped construction, but could be of a more abbreviated shape such as partial C-shaped or L-shaped as found to be necessary. Use of such additional structural support standards has been shown to provide significant additional strength as well as excellent resistance to flexing or deflection of the case configuration responsive to load or other forces.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. An improved refrigerated display case apparatus, with enhanced airflow characteristics and improved insulation means, comprising:

A. an insulated housing means comprising;

(1) an outer housing panel means including:

a. a lower outer section extending generally horizontally and including a lower outer section front end and a lower outer section rear end;

b. a front outer section extending generally vertically upwardly from said lower outer section front end;

c. a rear outer section extending generally vertically upwardly from adjacent said lower outer section rear end spatially disposed rearwardly from said front outer section;

d. an upper outer section extending forwardly from said rear outer section at a location above said lower outer section;

(2) an inner housing panel means mounted with respect to said outer housing panel means at a position spatially disposed therefrom to define an insulation chamber means therebetween, said inner housing panel also defining a refrigerated airflow path thereadjacent oppositely positioned from said insulation chamber means, said inner housing panel means including:

a. a lower inner section extending generally horizontally above said lower outer section and including a lower inner section front end and a lower inner section rear end;

b. a front inner section extending generally vertically upwardly from said lower inner section front end;

c. a rear inner section extending generally vertically upwardly from adjacent said lower inner section rear end spatially disposed rearwardly from said front inner section;

d. an upper inner section extending forwardly from said rear inner section at a location above said lower inner section;

e. a first inner transition section extending between said lower inner section and said front inner section and being arcuate therealong to facilitate the flow of refrigerated air thereagainst;

f. a second inner transition section extending between said lower inner section and said rear inner section and being arcuate therealong to facilitate the flow of refrigerated air thereagainst;

g. a third inner transition section extending between said rear inner section and said upper inner section and being arcuate therealong to facilitate the flow of refrigerated air thereagainst;

(3) a thermal breaker means attached to said outer housing panel means and said inner housing panel means at a position therebetween, said thermal breaker means maintaining said outer housing panel means and said inner housing panel means spatially disposed from one another to define said thermal insulation chamber means therebetween;

(4) a thermal insulation means positioned within said insulation chamber means between said outer housing panel means and said inner housing panel means and between said first lower thermal breaker means and said second lower thermal breaker means to facilitate insulation of the refrigerated display case and said refrigerated airflow path defined therein;

B. a shelf support standard means secured to said insulated housing means along said inner housing panel means thereof to provide structural strength to the display case apparatus, said shelf support standard means extending vertically to define a plurality of mounting positions thereon for receiving and retaining of a shelf means attached thereto; and C. a case liner means attached to said shelf support standard means in a position in spaced relation from said inner housing panel means of said insulated housing means to define a refrigerated air flow path therebetween.

2. An improved refrigerated display case apparatus, with enhanced airflow characteristics and improved insulation means, as defined in claim 1 wherein said first inner transition section, said second inner transition section and said third inner transition section of said inner housing panel means define a refrigerated airflow path thereadjacent having an radius of curvature of approximately 6 inches at all points therealong to facilitate refrigerated airflow therethrough.

3. An improved refrigerated display case apparatus, with enhanced airflow characteristics and improved insulation means, as defined in claim 1 wherein said thermal breaker means comprises:

A. a first lower thermal breaker means attached to said outer housing panel means along said lower outer section and attached to said inner housing panel means along said lower inner section, said first lower thermal breaker means being positioned between said outer housing panel means and said inner housing means to facilitate defining of said thermal insulation chamber means therebetween;

B. a second lower thermal breaker means attached to said outer housing panel means along said lower outer section and attached to said inner housing panel means along said lower inner section spatially disposed from said first lower thermal breaker means to define said thermal insulation chamber means therebetween;

C. a first upper thermal breaker means attached to said outer housing panel means along said upper outer section and attached to said inner housing panel means along said upper inner section, said first upper thermal breaker means being positioned between said outer housing panel means and said inner housing means to facilitate defining of said thermal insulation chamber means therebetween;

D. a second upper thermal breaker means attached to said outer housing panel means along said upper outer section and attached to said inner housing panel means along said upper inner section spatially disposed from said first upper thermal breaker means to define said thermal insulation means therebetween, said first upper thermal breaker means and said second upper thermal breaker means defining said thermal insulation chamber means therebetween;

E. first intermediate rear thermal member means extending between said first lower thermal breaker means and said first upper thermal breaker means for attachment therebetween to facilitate defining of said thermal insulation chamber means thereadjacent;

F. a first upper extension thermal member means extending generally horizontally forwardly from said first upper thermal breaker means to facilitate defining of said thermal insulation chamber means thereadjacent;

G. second intermediate rear thermal member means extending between said second lower thermal breaker means and said second upper thermal breaker means for attachment therebetween to facilitate defining of said thermal insulation chamber means thereadjacent; and H. a second upper extension thermal member means extending generally horizontally forwardly from said second upper thermal breaker means to facilitate defining of said thermal insulation chamber means thereadjacent.

4. An improved refrigerated display case apparatus, with enhanced airflow characteristics and improved insulation means, as defined in claim 1 wherein said shelf support standard means comprises:

A. a first shelf support standard secured to said insulated housing means along said inner housing panel means thereof, said first shelf support standard extending vertically to provide structural strength to the display case apparatus and to provide a plurality of mounting locations thereon for receiving and retaining a shelf means secured thereto; and B. a second shelf support standard secured to said insulated housing means along said inner housing panel means thereof at a location spatially disposed from said first shelf support standard, said second shelf support standard extending vertically to provide structural strength to the display case apparatus and to provide a plurality of mounting locations thereon for receiving and retaining a shelf means secured thereto.

5. An improved refrigerated display case apparatus, with enhanced airflow characteristics and improved insulation means, as defined in claim 1 further comprising a shelf means detachably securable with respect to said shelf support means to facilitate the placement of displayed product thereon.

6. An improved refrigerated display case apparatus, with enhanced airflow characteristics and improved insulation means, as defined in claim 3 wherein said first upper thermal breaker means and said second upper thermal breaker means are each L-shaped.

7. An improved refrigerated display case apparatus, with enhanced airflow characteristics and improved insulation means, as defined in claim 3 wherein said first lower thermal breaker means and said second lower thermal breaker means are each U-shaped.

8. An improved refrigerated display case apparatus, with enhanced airflow characteristics and improved insulation means, as defined in claim 1 further comprising a frame means fixedly secured to said insulated housing means for mounting thereon.

9. An improved refrigerated display case apparatus, with enhanced airflow characteristics and improved insulation means, as defined in claim 8 further including castor means detachably mounted to said frame means to facilitate relocation of the refrigerated display case.

10. An improved refrigerated display case apparatus, with enhanced airflow characteristics and improved insulation means, as defined in claim 9 further comprising a castor securement means including:

A. a plate means fixedly secured to said castor means;

B. a mounting bracket fixedly secured to said frame means and defining a mounting pocket therein adapted to receive said plate means detachably secured therein, said mounting bracket including:

(1) a shoulder member extending outwardly from said mounting bracket adjacent said mounting pocket defined therein to receive said mounting plate extending thereover to facilitate detachable securement within said mounting pocket;

(2) a locking pin;

(3) a mounting aperture defined by said mounting bracket and extending therethrough at a position spatially disposed from said shoulder member, said mounting aperture being adapted to receive said locking pin therein at a position below said plate means positioned within said mounting pocket for detachable securement thereof with respect to said mounting bracket, said plate means being detachable from said mounting bracket responsive to removal of said locking pin from said mounting aperture.

11. An improved refrigerated display case apparatus, with enhanced airflow characteristics and improved insulation means, as defined in claim 10 wherein said locking pin comprises a cotter pin.

12. An improved refrigerated display case apparatus, with enhanced airflow characteristics and improved insulation means, as defined in claim 1 further comprising a plurality of securement bolt assemblies extending through said insulated housing means for securement of said outer housing panel means with respect to said inner housing panel means.

13. An improved refrigerated display case apparatus, with enhanced airflow characteristics and improved insulation means, as defined in claim 12 wherein said securement bolt assemblies include thermally insulated bolt members to facilitate thermal insulation characteristics of said insulated housing means.

14. An improved refrigerated display case apparatus, with enhanced airflow characteristics and improved insulation means, as defined in claim 13 wherein said insulated bolt members are made of a thermally nonconductive fiber.

15. An improved refrigerated display case apparatus, with enhanced airflow characteristics and improved insulation means, as defined in claim 1 further comprising a lower end cap means extending between said front outer section and said front inner section to define said insulation chamber means therein and to retain said thermal insulation means therein.

16. An improved refrigerated display case apparatus, with enhanced airflow characteristics and improved insulation means, as defined in claim 1 further comprising an upper end cap means extending between said upper outer section and said upper inner section to define said insulation chamber means therein and to retain said thermal insulation means therein.

17. An improved refrigerated display case apparatus, with enhanced airflow characteristics and improved insulation means, as defined in claim 1 wherein said inner housing panel means of said insulated housing means and said case liner means defines a refrigerated air curtain upper outlet adjacent said upper inner section thereof.

18. An improved refrigerated display case apparatus, with enhanced airflow characteristics and improved insulation means, as defined in claim 1 wherein said inner housing panel means of said insulated housing means and said case liner means define a refrigerated air curtain lower inlet adjacent said lower front section thereof.

19. An improved refrigerated display case apparatus, with enhanced airflow characteristics and improved insulation means, as defined in claim 1 wherein said shelf support standard means is made of two inch square tubular steel to provide structural strength to the display case apparatus.

20. An improved refrigerated display case apparatus, with enhanced airflow characteristics and improved insulation means, as defined in claim 1 further comprising a plenum area positioned within said refrigerated airflow path and further including a refrigeration coil positioned therein to facilitate cooling of air passing therethrough and a fan means for urging air to pass through said refrigeration coil means for cooling thereof.

21. An improved refrigerated display case apparatus, with enhanced airflow characteristics and improved insulation means, comprising:

A. an insulated housing means comprising;

(1) an outer housing panel means including:

a. a lower outer section extending generally horizontally and including a lower outer section front end and a lower outer section rear end;

b. a front outer section extending generally vertically upwardly from said lower outer section front end;

c. a rear outer section extending generally vertically upwardly from adjacent said lower outer section rear end spatially disposed rearwardly from said front outer section;

d. an upper outer section extending forwardly from said rear outer section at a location above said lower outer section;

(2) an inner housing panel means mounted with respect to said outer housing panel means at a position spatially disposed therefrom to define an insulation chamber means therebetween, said inner housing panel also defining a refrigerated airflow path thereadjacent oppositely positioned from said insulation chamber means, said inner housing panel means including:

a. a lower inner section extending generally horizontally above said lower outer section and including a lower inner section front end and a lower inner section rear end;

b. a front inner section extending generally vertically upwardly from said lower inner section front end; a rear inner section extending generally vertically upwardly from adjacent said lower inner section rear end spatially disposed rearwardly from said front inner section;

d. an upper inner section extending forwardly from said rear inner section at a location above said lower inner section;

e. a first inner transition section extending between said lower inner section and said front inner section and being arcuate with a radius of curvature of approximately six inches at all points therealong to facilitate the flow of refrigerated air thereagainst;

f. a second inner transition section extending between said lower inner section and said rear inner section and being arcuate with a radius of curvature of approximately six inches at all points therealong to facilitate the flow of refrigerated air thereagainst;

g. a third inner transition section extending between said rear inner section and said upper inner section and being arcuate with a radius of curvature of approximately six inches at all points therealong to facilitate the flow of refrigerated air thereagainst;

(3) a thermal breaker means attached to said outer housing panel means and said inner housing panel means at a position therebetween, said thermal breaker means maintaining said outer housing panel means and said inner housing panel means spatially disposed from one another to define said thermal insulation chamber means therebetween, said thermal breaker means including;

a. a first lower thermal breaker means being generally U-shaped and being attached to said outer housing panel means along said lower outer section and attached to said inner housing panel means along said lower inner section, said first lower thermal breaker means being positioned between said outer housing panel means and said inner housing means to facilitate defining of said thermal insulation chamber means therebetween;

b. a second lower thermal breaker means being generally U-shaped and being attached to said outer housing panel means along said lower outer section and attached to said inner housing panel means along said lower inner section spatially disposed from said first lower thermal breaker means to define said thermal insulation chamber means therebetween;

c. a first upper thermal breaker means being generally L-shaped and being attached to said outer housing panel means along said upper outer section and attached to said inner housing panel means along said upper inner section, said first upper thermal breaker means being positioned between said outer housing panel means and said inner housing means to facilitate defining of said thermal insulation chamber means therebetween;

d. a second upper thermal breaker means being generally L-shaped and attached to said outer housing panel means along said upper outer section and attached to said inner housing panel means along said upper inner section spatially disposed from said first upper thermal breaker means to define said thermal insulation means therebetween, said first upper thermal breaker means and said second upper thermal breaker means defining said thermal insulation chamber means therebetween.

(4) a thermal insulation means positioned within said insulation chamber means between said outer housing panel means and said inner housing panel means and between said first lower thermal breaker means and said second lower thermal breaker means to facilitate insulation of the refrigerated display case and said refrigerated airflow path defined therein;

B. a shelf support standard means secured to said insulated housing means along said inner housing panel means thereof to provide structural strength to the display case apparatus, said shelf support standard means extending vertically to provide structural strength to the display case apparatus and to define a plurality of mounting positions thereon for receiving and retaining of a shelf means attached thereto, said shelf support standard means further including;

(1) a first shelf support standard of square tubular steel secured to said insulated housing means along said inner housing panel means thereof, said first shelf support standard extending vertically to provide structural strength to the display case apparatus and to provide a plurality of mounting locations thereon for receiving and retaining a shelf means secured thereto;

(2) a second shelf support standard of square tubular steel secured to said insulated housing means along said inner housing panel means thereof at a location spatially disposed from said first shelf support standard, said second shelf support standard extending vertically to provide structural strength to the display case apparatus and to provide a plurality of mounting locations thereon for receiving and retaining a shelf means secured thereto;

C. a case liner means attached to said first shelf support standard means and said second shelf support standard means and extending therebetween in spaced relation from said inner housing panel means of said insulated housing means to define a refrigerated air flow path therebetween;

D. a shelf means detachably securable with respect to said shelf support means to facilitate the placement of displayed product thereon;

E. a frame means fixedly secured to said insulated housing means for mounting thereon;

F. a castor means being detachably securable with respect to said frame means to facilitate relocation of a refrigerated display case;

G. a castor securement means comprising:

(1) a plate means fixedly secured to said castor means;

(2) a mounting bracket fixedly secured to said frame means and defining a mounting pocket therein adapted to receive said plate means detachably secured therein, said mounting bracket including:

a. a shoulder member extending outwardly from said mounting bracket adjacent said mounting pocket defined therein to receive said mounting plate extending thereover to facilitate detachable securement within said mounting pocket;

b. a locking pin comprising a cotter pin; and c. a mounting aperture defined by said mounting bracket and extending therethrough at a position spatially disposed from said shoulder member, said mounting aperture being adapted to receive said locking pin therein at a position below said plate means positioned within said mounting pocket for detachable securement thereof with respect to said mounting bracket, said plate means being detachable from said mounting bracket responsive to removal of said locking pin from said mounting aperture;

H. a plurality of securement bolt assemblies extending through said insulated housing means for securement of said outer housing panel means with respect to said inner housing panel means, each of said securement bolt assemblies including a thermally insulated bolt member of fiber material;

I. a lower end cap means extending between said front outer section and said front inner section to define said insulation chamber means therein and to retain said thermal insulation means therein; and J. an upper end cap means extending between said upper outer section and said upper inner section to define said insulation chamber means therein and to retain said thermal insulation means therein.

* * * * *

UNITED STATES PATENT AND TRADEMARK OFFICE

CERTIFICATE OF CORRECTION

PATENT NO. : 5,475,987

DATED : December 19, 1995

INVENTOR(S) : Christopher McGovern

It is certified that error appears in the above–identified patent and that said Letters Patent is hereby corrected as shown below:

On title page, item [73] "Assignee", change "Medical" to -- Capital --.

In column 16, line 54, insert -- c. -- before "a rear...".

Signed and Sealed this

Twenty-sixth Day of March, 1996

*Attest:*

Bruce Lehman

BRUCE LEHMAN

*Attesting Officer*

*Commissioner of Patents and Trademarks*